US007374423B2

(12) United States Patent
Hsu

(10) Patent No.: US 7,374,423 B2
(45) Date of Patent: May 20, 2008

(54) CONDUCTING STRIP FOR CONNECTION DEVICE

(75) Inventor: Jung-Hui Hsu, Chung Ho (TW)

(73) Assignee: Powertech Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 11/517,413

(22) Filed: Sep. 8, 2006

(65) Prior Publication Data

US 2008/0009144 A1 Jan. 10, 2008

(30) Foreign Application Priority Data

Jul. 7, 2006 (TW) ..... 95212032 U

(51) Int. Cl.
*H01R 39/00* (2006.01)

(52) U.S. Cl. ..... 439/31; 439/954

(58) Field of Classification Search ..... 439/492–495, 439/31, 954
See application file for complete search history.

(56) References Cited

U.S. PATENT DOCUMENTS 4,846,709 A * 7/1989 Kobayashi et al. ..... 439/161
4,938,702 A * 7/1990 English ..... 439/67

* cited by examiner

*Primary Examiner*—Truc T Nguyen
(74) *Attorney, Agent, or Firm*—Rosenberg Klein & Lee

(57) ABSTRACT

A conducting strip for a connection device comprises a first conducting strip, a second conducting strip, and an elastic clipping element. One side of the second conducting strip is contacted with one side of the first conducting strip, and the two contacted sides are clipped by the elastic clipping element so that the first conducting strip and the second conducting strip can be connected movably to provide conductive purpose and assembled easily to reduce costs.

11 Claims, 7 Drawing Sheets

CONDUCTING STRIP FOR CONNECTION DEVICE

BACKGROUND OF THE INVENTION

1. Field of the invention

The present invention relates to a conducting strip for a connection device, and more particularly to a conducting strip, which is installed in outlets or plugs so as to not only provide conductive purpose but also can be rotated and moved freely.

2. Description of the Prior Art

Outlets and plugs are adapted to connect sources of various electric instruments. Due to intensive competition in the market of the electric instruments, new outlets and plugs are being launched to enhance complete functions. And existing outlets and plugs have rotatable function to be adjusted in different angles according to actual requirements. For example, the conventional rotatable outlet set, as the TW Patent M267717 is published in 11 Jun. 2005.

The conventional outlets and plugs all have conducting strips, are also called cooper scraps or terminals, therein to obtain conductive effect. In order to provide rotatable outlets or plugs, the conducting strips have been designed in two-piece type, and the two conducting strips are pivotally engaged mutually by a pivot so as to adjust the outlets or plugs in different angles. However, it is inconvenient to assemble the conducting strips to increase costs.

The inventor of the present invention recognizes the above shortage should be corrected and special effort has been paid to research this field. The present invention is presented with reasonable design and good effect to resolve the above problems.

SUMMARY OF THE INVENTION

It is a primary object of the present invention to provide a conducting strip for a connection device that a first conducting strip and a second conducting strip can be connected movably to provide conductive purpose and assembled easily to reduce costs.

To achieve the objective stated above, the conducting strip for a connection device comprises a first conducting strip; a second conducting strip, one side of the second conducting strip is contacted with one side of the first conducting strip; and an elastic clipping element is used to clip the two contacted sides of the second conducting strip and the first conducting strip.

The present invention has the following advantages:

The elastic clipping element is adapted to clip the first conducting strip and the second conducting strip so that the first conducting strip and the second conducting strip can be connected movably to provide conductive purpose and assembled easily to reduce costs.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF THE DRAWINGS

The above and further advantages of this invention may be better understood by referring to the following description, taken in conjunction with the accompanying drawings, in which.

The drawings will be described further in connection with the following detailed description of the present invention.

DETAILED DESCRIPTION OF THE PREFERRED EMBODIMENTS

Figure 1:
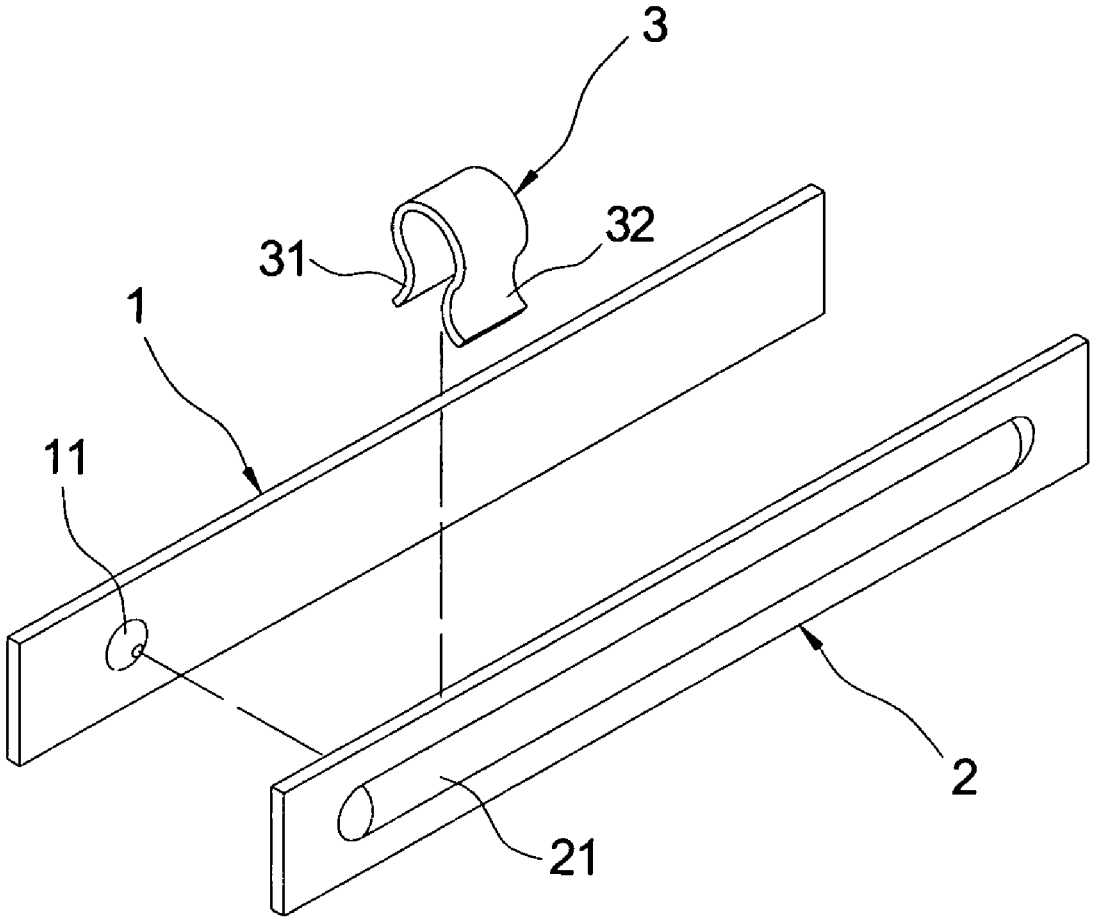
FIG. 1 is an exploded perspective view of a first embodiment of a conducting strip for a connection device according to the present invention.
Figure 2:
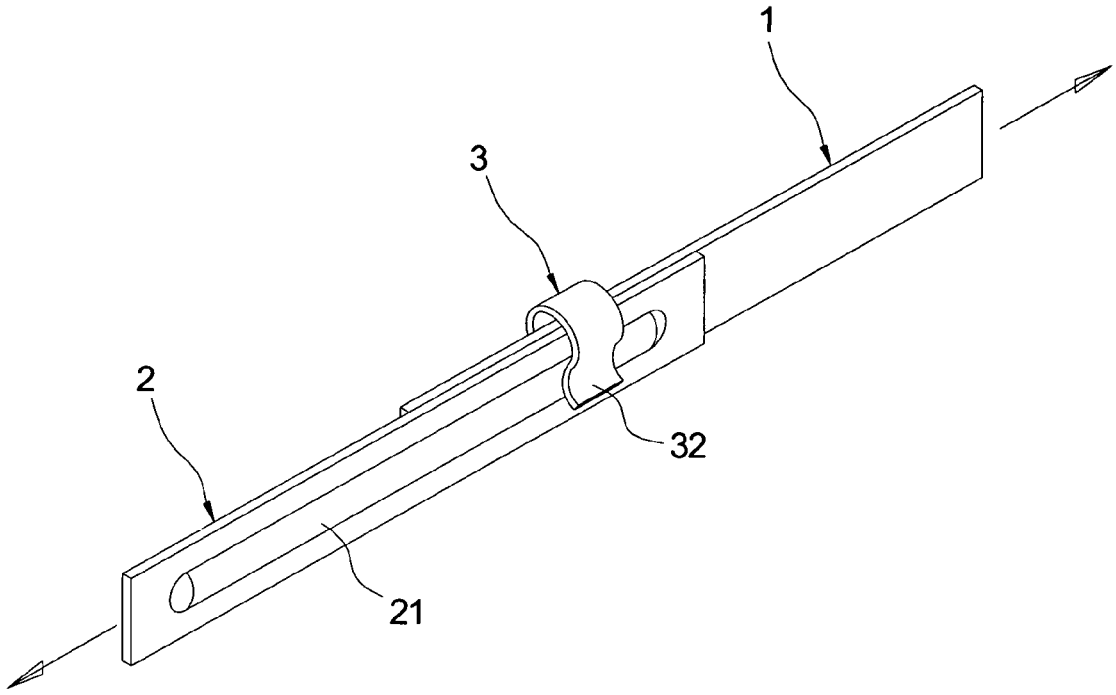
FIG. 2 is an assembled perspective view of a first embodiment of a conducting strip for a connection device according to the present invention.

References are shown as in FIG. 1 and FIG. 2 which are an explode perspective view and an assembled perspective view of a first embodiment of a conducting strip for a connection device according to the present invention. The present invention provides a conducting strip for a connection device, wherein the embodiment discloses a movable structure that can be installed in outlets or plugs, and comprises a first conducting strip 1, a second conducting strip 2, and an elastic clipping element 3. Wherein the first conducting strip 1 is made of cooper and is a long-shaped plate, and a bump 11 is punched near one end of the first conducting strip 1 and the bump 11 is circular-point-shaped and protruded to the contacted sides of the first conducting strip 1 and the second conducting strip 2.

The second conducting strip 2 is made of cooper and is a long-shaped plate, and a long-shaped guiding slot 21 is punched from the second conducting strip 2 and the guiding slot 21 is extended horizontally near two ends of the second conducting strip 2 and sunken into the contacted sides of the first conducting strip 1 and the second conducting strip 2.

The above-mentioned first conducting strip 1 and the second conducting strip 2 can be formed and electrically connected with contacting portions, wiring portions of outlets or plugs (not shown) according to actual requirements. One side of the first conducting strip 1 is contacted partially with one side of the second conducting strip 2 to form a side-to-side contact between the first conducting strip 1 and the second conducting strip 2 so that the bump 11 can be disposed movably in the guiding slot 21 to change whole length by guiding relatively the first conducting strip 1 and the second conducting strip 2.

The elastic clipping element 3 is made of an elastic material and formed by curving a metal plate in the embodiment, and shape and structure of the elastic clipping element 3 aren't limited in present invention. In the embodiment, the elastic clipping element 3 is Ω-shaped and a first clipping portion 31 and a second clipping portion 32 are formed in two ends of the elastic clipping element 3. The elastic clipping element 3 is stridden on the first conducting strip 1 and the second conducting strip 2 and the first clipping portion 31 and the second clipping portion 32 are adapted to clip elastically the first conducting strip 1 and the second conducting strip 2 separately to form a conducting strip for a connection device.

Figure 3:
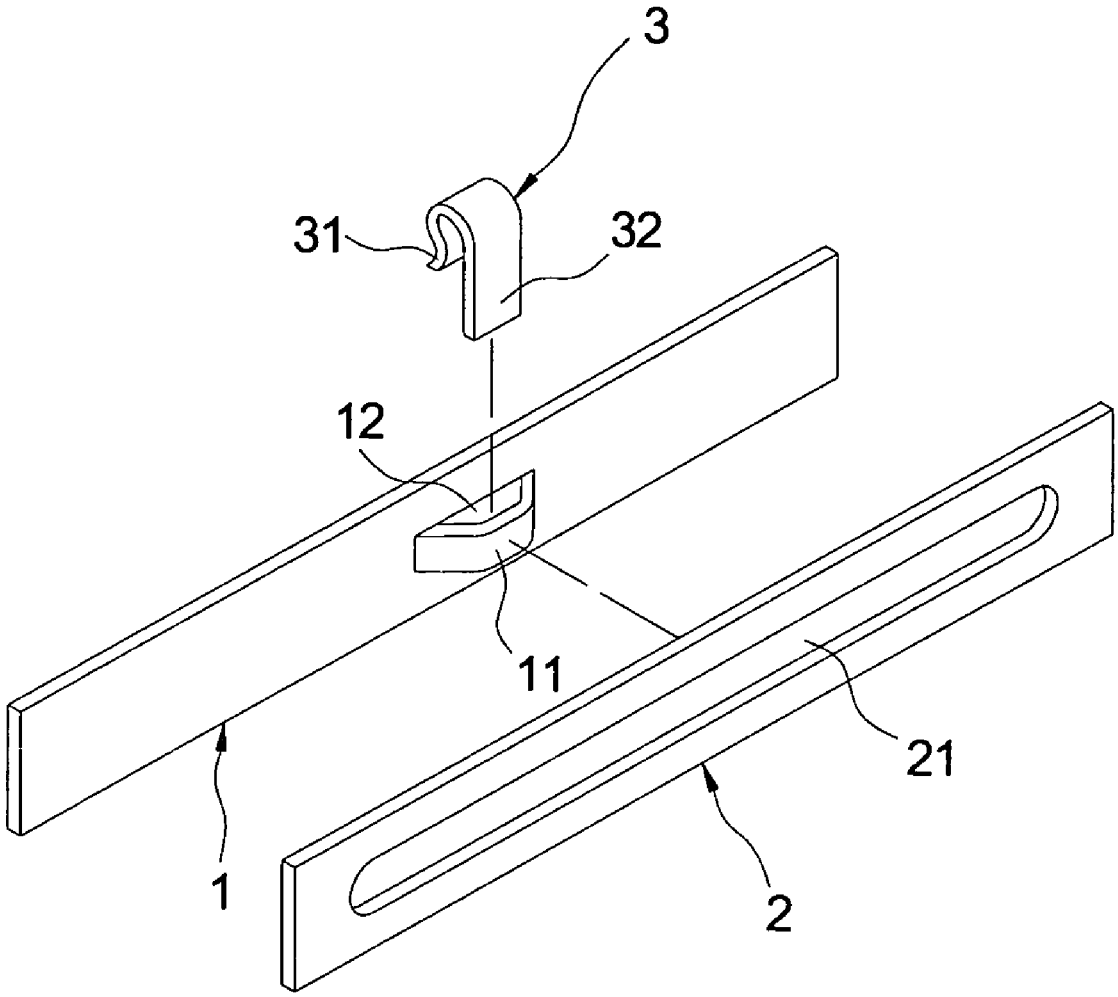
FIG. 3 is an exploded perspective view of a second embodiment of a conducting strip for a connection device according to the present invention.
Figure 4:
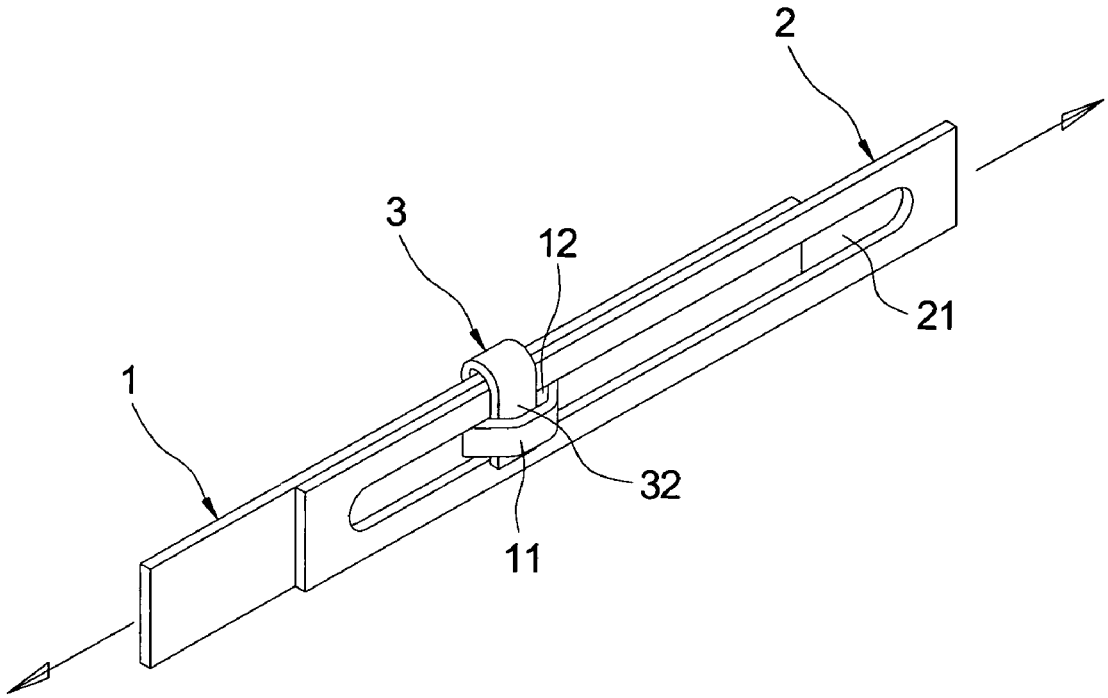
FIG. 4 is an assembled perspective view of a second embodiment of a conducting strip for a connection device according to the present invention.

References are shown as in FIG. 3 and FIG. 4 which are an explode perspective view and an assembled perspective view of a second embodiment of a conducting strip for a connection device according to the present invention. The difference between the first embodiment and the second embodiment is that the bump 11 is formed protrudingly in a middle of the first conducting strip 1 by curving a metal plate and forms a positioning hole 12 therein. The guiding slot 21 is penetrated through two sides of the second conducting strip 2 and the bump 11 can be disposed movably in the guiding slot 21 to change whole length by guiding relatively the first conducting strip 1 and the second conducting strip 2. Furthermore, the first clipping portion 31 and the second clipping portion 32 are asymmetric-shaped, and the second clipping portion 32 is inserted into the positioning hole 12 of the bump 11 to enhance clipping effect of the elastic clipping element 3.

Figure 5:
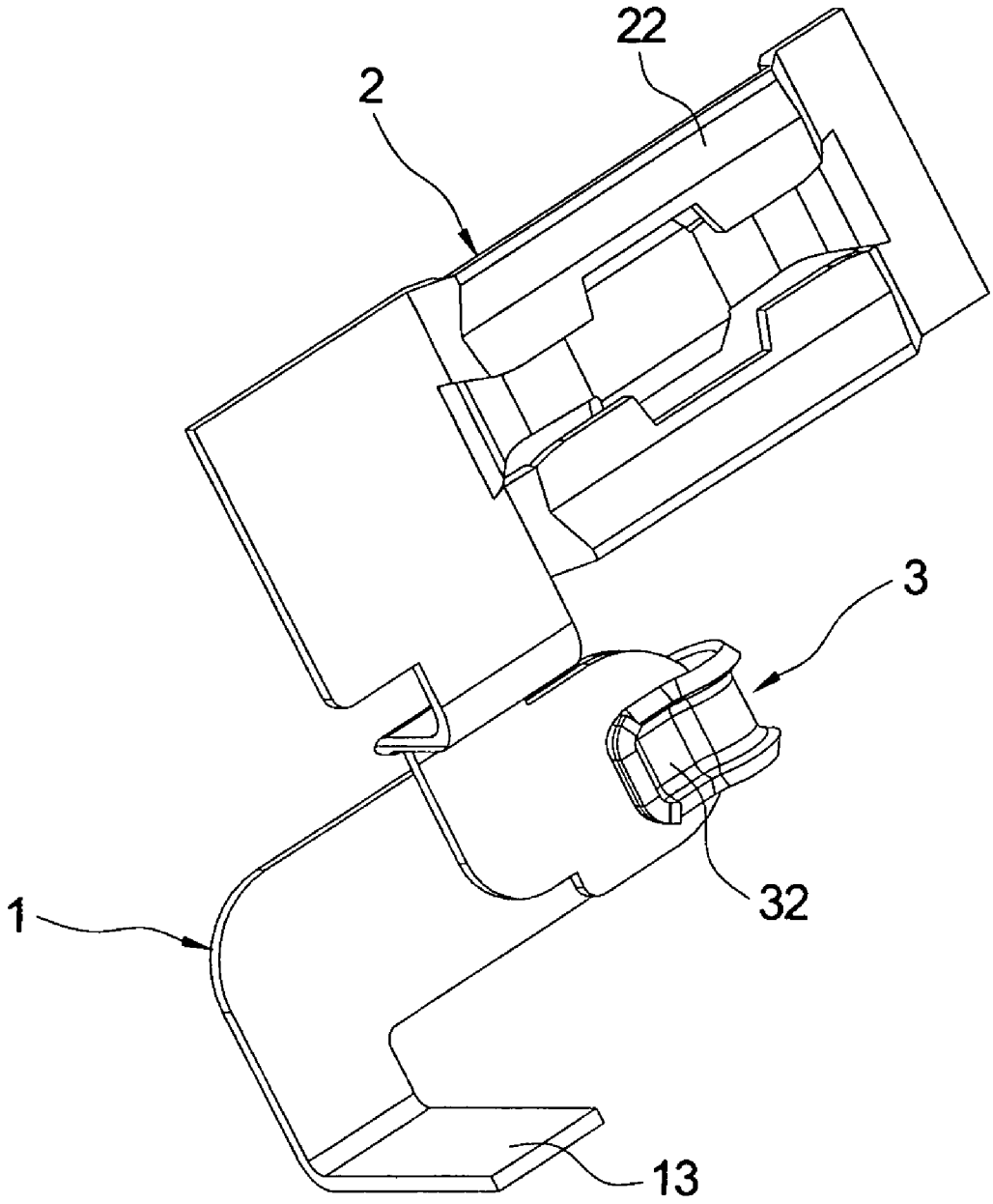
FIG. 5 is an assembled perspective view of a third embodiment of a conducting strip for a connection device according to the present invention.
Figure 6:
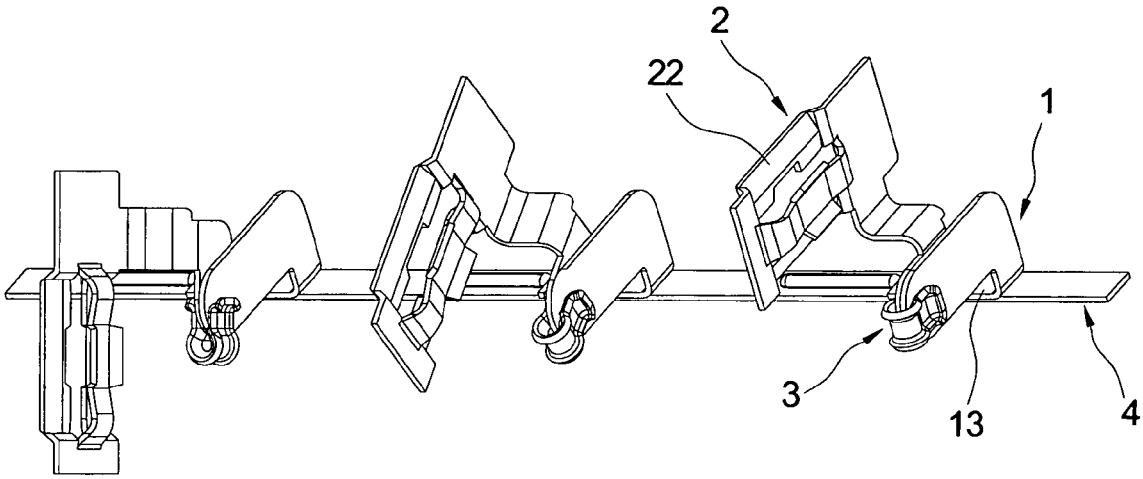
FIG. 6 is an assembled perspective view of a third embodiment for using of a conducting strip for a connection device according to the present invention.

Reference is shown as in FIG. 5, which is an assembled perspective view of a third embodiment of a conducting strip for a connection device according to the present invention. The embodiment of the present invention discloses a rotatable structure that can be installed in the outlet. The difference between the above-mentioned embodiments is that shapes and structures of the first conducting strip 1 and the second conducting strip 2 are different. One side of the first conducting strip 1 is contacted partially with one side of the second conducting strip 2, and the elastic clipping element 3 is adapted to clip the first conducting strip 1 and the second conducting strip 2. The first conducting strip 1 is pivotally engaged with the second conducting strip 2 by the elastic clipping element 3 so that the first conducting strip 1 and the second conducting strip 2 are rotatable (shown in FIG. 6) to adjust the outlet in different angles.

The above-mentioned first conducting strip 1 and the second conducting strip 2 further extends separately a fixing portion 13 and a contacting portion 22. The fixing portion 13 can be fixed in a third conducting strip 4 of the outlet and the contacting portion 22 is electrically connected with the fixing portion 13.

Figure 7:
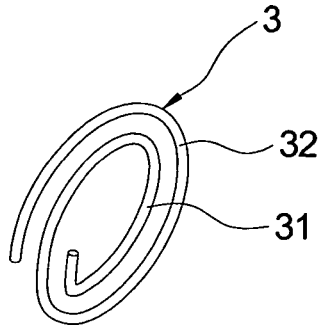
FIG. 7, FIG. 8, and FIG. 9 are perspective views of other embodiments of an elastic clipping element according to the present invention.
Figure 8:
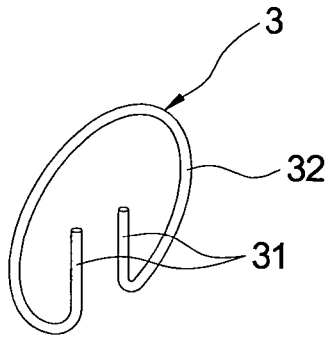
Figure 9:
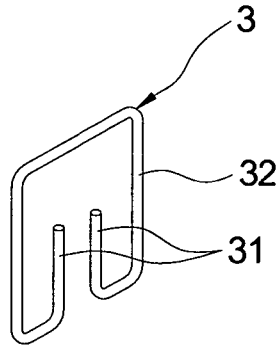

References are shown as from FIG. 7 to FIG. 9, which are perspective views of other embodiments of an elastic clipping element according to the present invention. The elastic clipping element 3 is made of an elastic material and formed by curving a metal wire. Wherein the first clipping portion 31 and the second clipping portion 32 are formed in two ends or middle of the metal wire, and the elastic clipping element 3 is adapted to clip the first conducting strip 1 and the second conducting strip 2.

The conducting strip for a connection device of the present invention provides the elastic clipping element 3 is adapted to clip the first conducting strip 1 and the second conducting strip 2 so that the first conducting strip 1 and the second conducting strip 2 can be rotated and moved freely and provided conductive purpose. Further, the elastic clipping element 3 is adapted to clip the first conducing strip 1 and the second conducting strip 2 in a simple structure to reduce costs. Furthermore, one side of the first conducting strip 1 is contacted partially with one side of the second conducting strip 2 to form a side-to-side contact between the first conducting strip 1 and the second conducting strip 2 so that the elastic clipping element 3 can clip firmly the two conducting strips to obtain good conductive effect.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A conducting strip for a connection device, comprising:

a first conducting strip;

a second conducting strip, one face of said second conducting strip contacted with one face of said first conducting strip; and an elastic clipping element clipping said first conducting strip to said second conducting strip for maintaining conductive contact between said first and second conducting strips; and said first and second conducting strips being pivotally engaged and rotatable each with respect to the other about said elastic clipping element while maintaining an electrical path from said first to said second conducting strip.

2. The conducting strip for a connection device as claimed in claim 1, wherein the first conducting strip forms a bump protruded from the side contacted with the second conducting strip thereof, and the second conducting strip forms a long-shaped guiding slot and the bump which is disposed movably in the guiding slot.

3. The conducting strip for a connection device as claimed in claim 2, wherein the guiding slot is indented at the side of the second conducting strip contacted with the first conducting strip.

4. The conducting strip for a connection device as claimed in claim 2, wherein the bump forms a positioning hole therein, and the elastic clipping element is inserted into the positioning hole.

5. The conducting strip for a connection device as claimed in claim 2, wherein the guiding slot is penetrated through two sides of the second conducting strip.

6. The conducting strip for a connection device as claimed in claim 1, wherein the side of the first conducting strip is contacted partially with the side of the second conducting strip.

7. The conducting strip for a connection device as claimed in claim 1, wherein the first conducting strip and the second conducting strip are both movable.

8. The conducting strip for a connection device as claimed in claim 1, wherein the elastic clipping element is formed by curving a metal plate.

9. The conducting strip for a connection device as claimed in claim 1, wherein the elastic clipping element that is formed by curving a metal wire.

10. The conducting strip for a connection device as claimed in claim 1, wherein the elastic clipping element has a first clipping portion and a second clipping portion to clip elastically the first conducting strip and the second conducting strip separately.

11. The conducting strip for a connection device as claimed in claim 1, wherein the elastic clipping element is made of an elastic material.

* * * * *